United States Patent [19]

Chrzanowski et al.

[11] Patent Number: 4,718,545

[45] Date of Patent: Jan. 12, 1988

[54] CARTON FOR SHIPPING AND DISPLAY

[75] Inventors: John G. Chrzanowski, New York, N.Y.; Janice A. Jaworski, Norwalk, Conn.

[73] Assignee: Swingline Inc., Long Island City, N.Y.

[21] Appl. No.: 925,447

[22] Filed: Oct. 31, 1986

[51] Int. Cl.[4] ..... B65D 0.5/52

[52] U.S. Cl. ..... 206/45.15; 206/45; 206/45.29; 206/45.31; 206/45.18

[58] Field of Search ..... 206/45, 45.14, 45.15, 206/45.18, 45.28, 45.29, 45.31

[56] References Cited

U.S. PATENT DOCUMENTS

| | | | |
|---|---|---|---|
| 1,251,008 | 12/1917 | Furste | 206/45.29 |
| 2,314,304 | 3/1943 | Brennell | 206/45.29 X |
| 2,647,621 | 8/1953 | Bowden | 206/45.29 X |
| 2,649,195 | 8/1953 | Rossi et al. | 206/45.29 |
| 2,649,240 | 8/1953 | Gilbert | 206/45.29 X |
| 2,830,697 | 4/1958 | Paige | 206/45.29 |
| 3,219,181 | 11/1965 | Dahm | 206/45.29 X |
| 3,729,091 | 4/1973 | Davis | 206/45.29 X |
| 4,417,655 | 11/1983 | Forbes, Jr. | 206/45.29 X |

FOREIGN PATENT DOCUMENTS

| | | | |
|---|---|---|---|
| 1189510 | 3/1959 | France | 206/45.29 |
| 355560 | 8/1931 | United Kingdom | 206/45.29 |
| 1080421 | 8/1967 | United Kingdom | 206/45.29 |

*Primary Examiner*—William Price

*Attorney, Agent, or Firm*—Pennie & Edmonds

[57] ABSTRACT

A carton for shipping and display of contained products, which carton has an end closure arrangement which can be manipulated to three (3) positions; a first position closed and locked; a second in which the closure is open for display; and a third position in which the closure is closed for display. The carton includes a stand and removal pannels to reveal to prospective buyers the contained products.

5 Claims, 8 Drawing Figures

CARTON FOR SHIPPING AND DISPLAY

BACKGROUND OF THE INVENTION

Numerous foldable boxes have been proposed for use as shipping containers. Boxes have also been designed to be useful, upon refolding or other conversion, as display containers for merchandise.

Prior boxes have not included the simplicity of design, ease of convertibility and versatility of use of the device of the present invention.

SUMMARY OF THE INVENTION

Broadly, the present invention comprises a foldable shipping and display carton made from a carton blank having a rectilinear body, an upper multisectional flap and side tab arrangement including a main flap hinged from said body and two minor side tabs which arrangement is capable of manipulation to three (3) positions; one (1) closed and locked position and two (2) display positions. Main flap has three (3) tandem sections foldable to various positions and held by side tabs or by a body tab piece to create the three (3) positions It is a feature that the side tabs carry multiple creases to make them more flexible and permit easy tucking of the tabs between the container body and its contents.

It is a further feature that the carton container body includes stand means for standing up the carton for display.

DESCRIPTION OF THE PREFERRED EMBODIMENT

Figure 1:
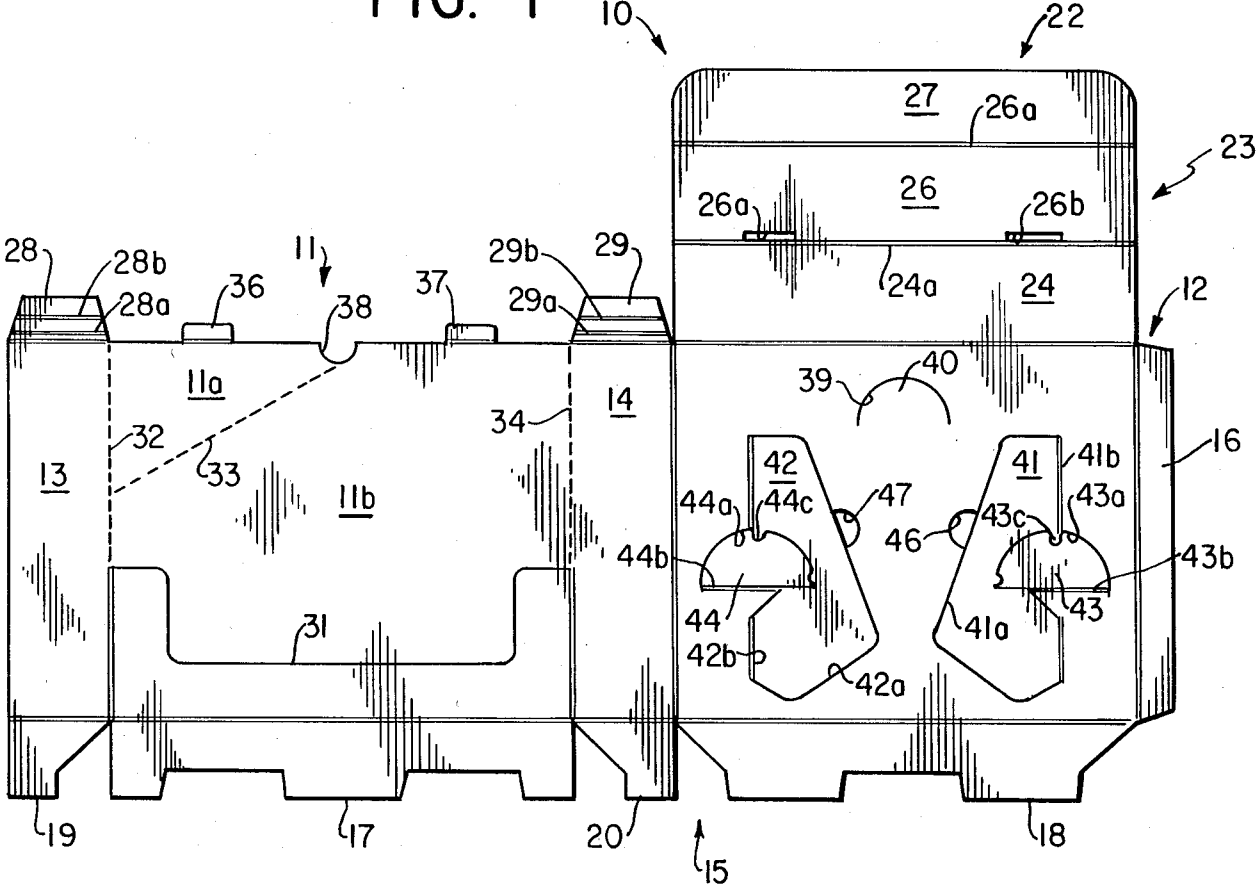
FIG. 1 is a plan view of the cardboard carton blank.

In the figures, cardboard carton blank 10 includes front top panel 11, back bottom panel 12, exterior side panel 13, middle side panel 14, and glue flap 16. Also shown are lower closure arrangement 15 including notched flaps 17, 18 and tabs 19, 21 which interlock in a known way to form the lower end closure (not shown as assembled and interlocked). Upper end closure and display arrangement 22 includes foldable hinged panel 23 including first panel section 24, second panel section 26, hinged to the first section 24 and the third panel section 27 hinged to the second section 26. Hinge crease lines **24*a* and 26*a* permit ready folding of panel 23. Closure and display arrangement 22 includes flexible multicreased side locking tabs 28, 29 with tab 28 having creases 28*a*, 28*b* and tab 29 having crease lines 29*a*, 29*b*. Front top panel 11 includes cut-through severence line 31 and score lines 32, 33 and 34 to permit removal of front panel triangular portion 11*a* or front panel portion 11*b* for display purposes as further explained. Front top panel 11 includes locking projections 36, 37 for insertion into hinged panel slots 26*a*, 26*b***.

Finally, blank 10 includes oval thumb notch 38 formed in panel 11; semicircular cut-through severance line 39 in panel 12 creates tab 40, and right and left upright pieces 41, 42 having cutlines **41*a*, 41*b* and hinges at fold lines 41*b* and 42*b*; right and left notched brace half-moon sections 43, 44 having cutlines 43*a*, 44*a*; fold hinge lines 43*b*, 44*b* and upright-engaging notches 43*c*, 44*c*. Thumb notches 46, 47 assist in assembling stands 48, 49 as partially shown in FIG. 4**.

Figure 2:
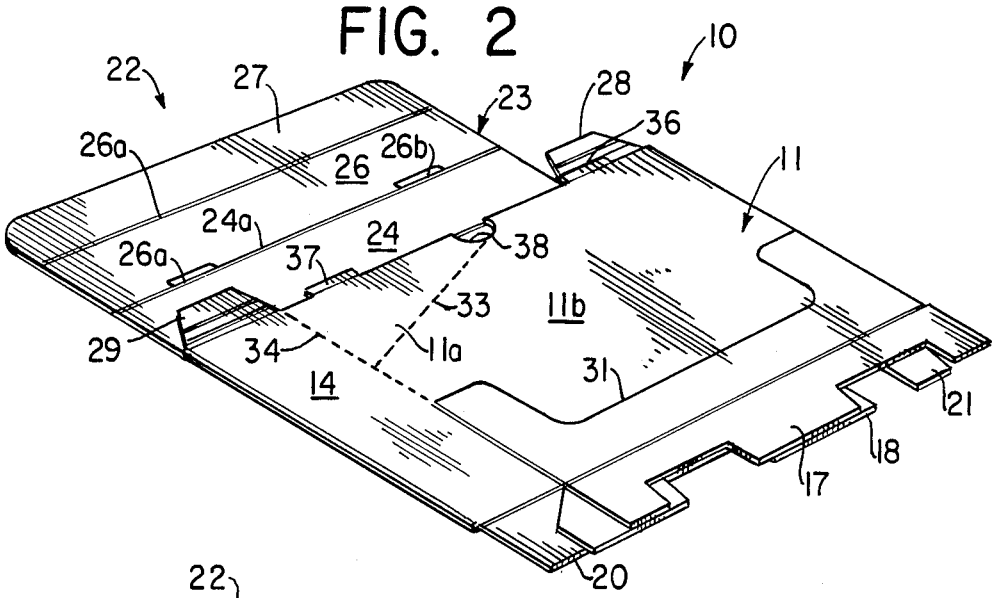
FIG. 2 is a perspective view of the carton partially assembled, glued and collapsed.
Figure 3:
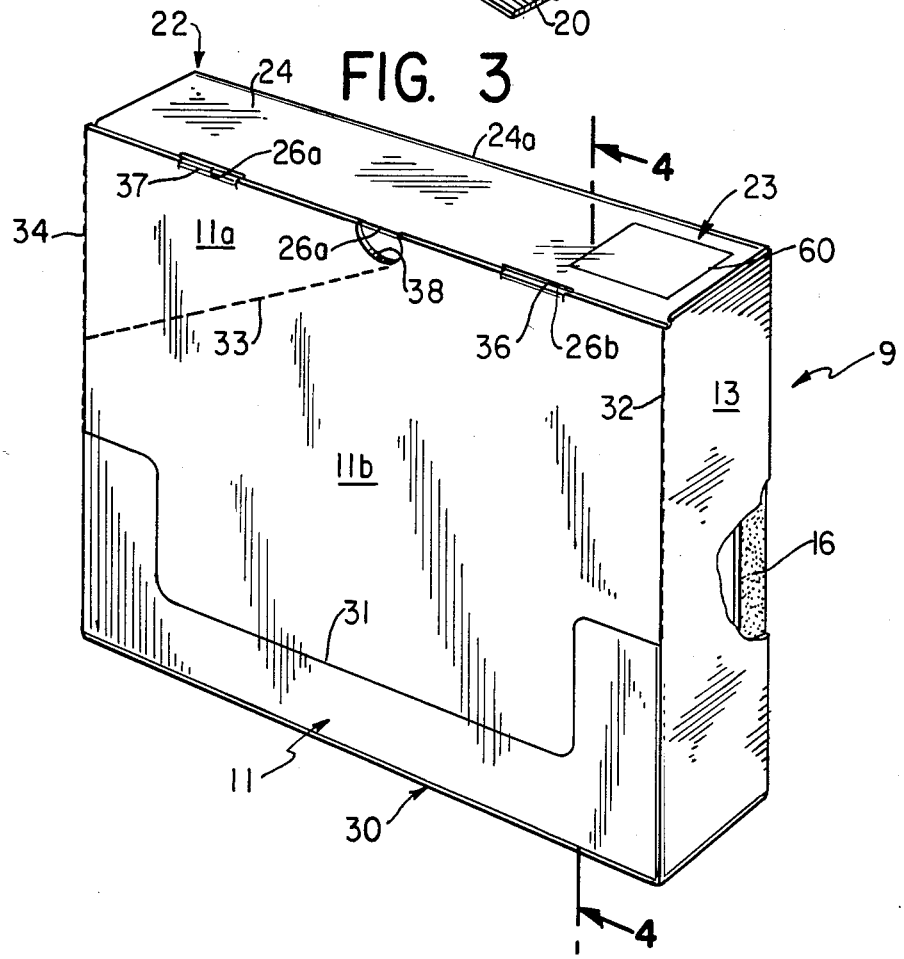
FIG. 3 is a perspective view of the carton assembled for shipping with a partial cutaway view.

Turning to FIGS. 2 and 3, blank 10 is shown with glue flap 16 glued to exterior side panel 13 and with the blank top, bottom and side panels 11, 12, 13 and 14 in flat knockdown position with foldable upper hinged panel 23, including panel sections 24, 26 and 27 in unfolded extended position. Blank 10 may be shipped in this knockdown position for later erection as carton 9. Carton 9 may house the contents of office supply items, such as folders or binders for letter size or other sizes of paper. As assembled, panels 11, 12, 13, and 14, flaps 17 and 18, and tabs 19, 21 form rectilinear carton container body 30. With lower and upper end closures 15, 22 arranged in their closed position, carton 9 provides a strong integral shipping container which can withstand the forces applied during handling including being dropped without breaking open. Panel sections 26, 27 are inserted into the carton body 30 while section 24 serves as the carton top end. Tabs 36 and 37 are inserted in slots **26*a*, 26*b* to lock panel section 24 closed. Panel section 24 carries display picture square 45 (or other pictorial or information material) for informing the viewer what is contained in carton 9**.

Figure 4:
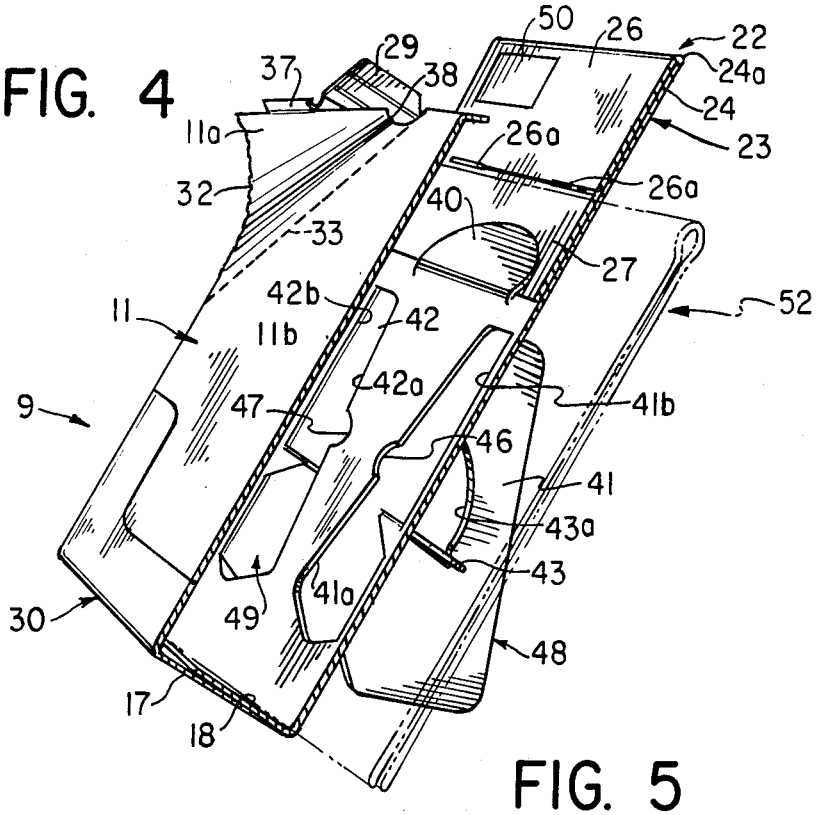
FIG. 4 is a sectional view taken along line 4—4 of FIG. 3 showing stand uprights and a carton contained product in phantom.

In FIG. 4, stand uprights 41, 42 are deployed and carton 9 is leaning back (from the upright FIG. 3 position) as supported by the stands 48, 49. Foldable hinged multisection panel 23 is folded with section 27 superimposed on panel section 24 and panel section 26 tucked under the semicircle tab 40. Panel section 27 carries pictorial information such as picture box 50. Also shown are front panel 11 and removable panel **11*a* in the process of being removed through tearing of scoreline 32. In FIG. 4, panel sections 24, 26 and 27 are parallel to panel 12 of container body 30. Side tab 28 and a phantom view of a sheet paper folder 52 are also shown. Carton 9 functions as a display carton supported by stands 48, 49; panel 11*a* removed to display a portion of the interior positioned folder 52 and with panel section 27** carrying pictorial or other point of sale information.

Figure 5:
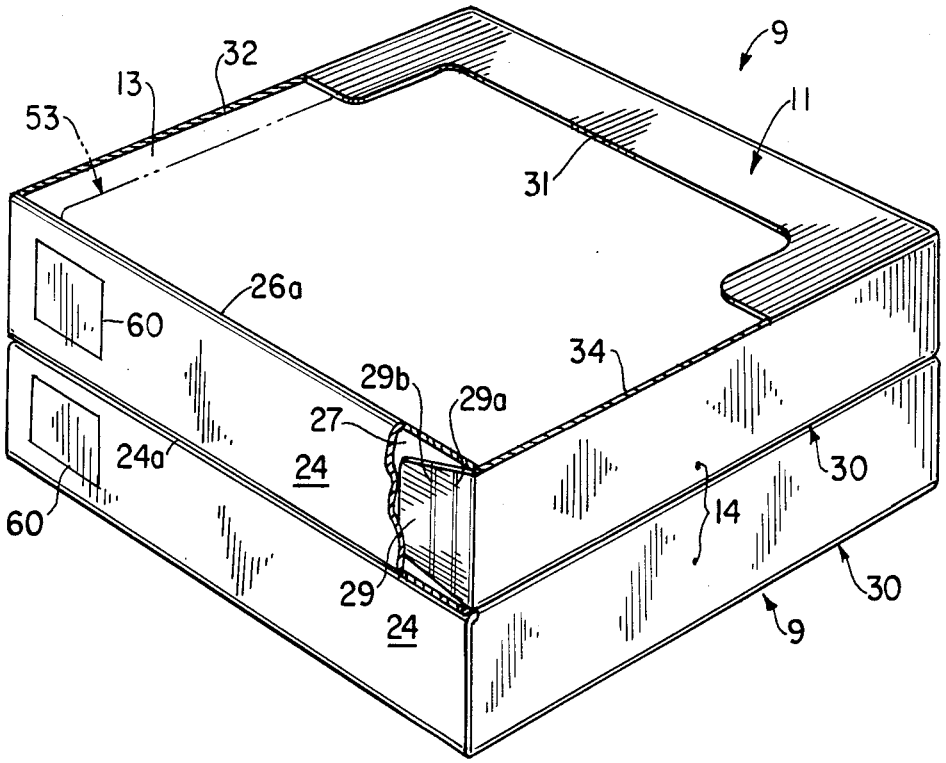
FIG. 5 is a perspective view of two (2) cartons in stacked display position with a partial cutaway of the front top panel of the upper carton.
Figure 7:
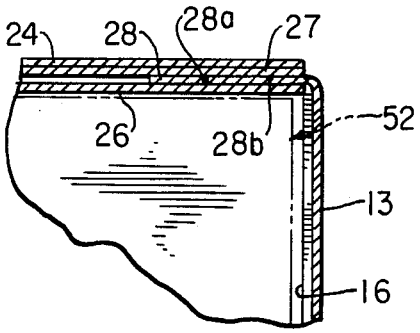
FIG. 7 is a partial cutaway of a corner of the carton showing a multicreased side tab inserted into and forming a part of the upper main flap arrangement as folded.

Turning to FIGS. 5 and 7, an alternative manner of using carton 9 as a display carton is shown. Both cartons 9 are positioned on their back bottom panel 12 and the larger removable panel portion **11*b* being removed to expose the carton contents (not shown). As shown in FIG. 7 panel sections 24, 26, and 27 are folded until each is parallel to the other and all are perpendicular to carton panel 11. Tab 28 is shown tucked into a position between sections 24 and 27 to hold foldable hinged panel 23 in its triple folded position. Panel section 24 carries information box 60**.

Figure 6:
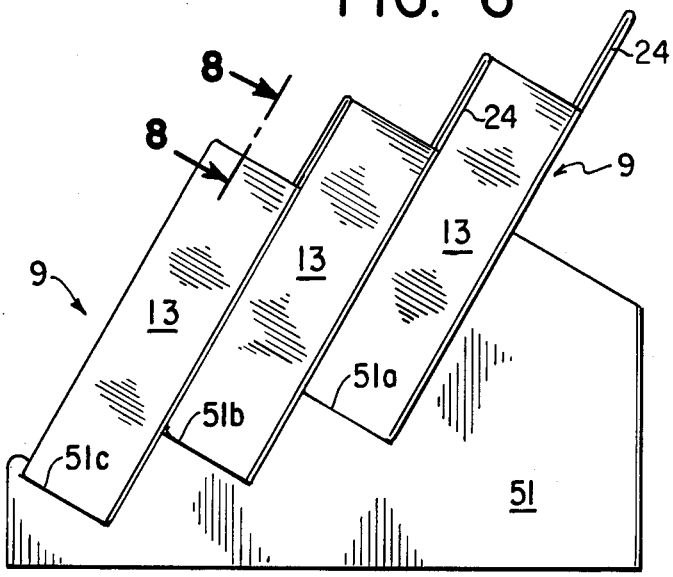
FIG. 6 is an end view of a plurality of the cartons in a tier rack.
Figure 8:
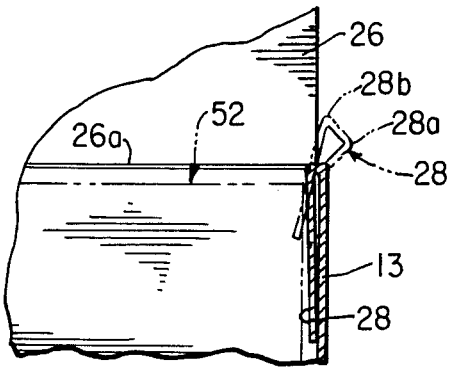
FIG. 8 is a partial sectional view taken along line 8—8 of FIG. 6 showing the flexible side tab being tucked between carton wall and contained carton product.

FIGS. 6 and 8 illustrate three (3) cartons 9 on a rack 51 which rack has inclined support surfaces 51*a*, 51*b*, and 51*c*. In FIG. 8, tab 28 having creases 28*a*, 28*b* permits the tab 28 to be bent to ease its insertion between side 13 (with glue flap 16) and a paper sheet folder 52 with folder edge 52 positioned in carton 9.

We claim:

1. A carton for use as a shipping and display container comprising:

(a) a rectilinear product container body including front top panel, back bottom panel, side panels and locking bottom panels;

(b) an upper opening flap arrangement including a main flap hinged to the back bottom panel, two minor side tabs hinged to said side panels, the upper opening flap including three tandem flap sections; such upper opening flap arrangement in turn having (i) a first closed position for shipping;

(ii) a second open position in which a flap section of the main flap extends beyond the container body in the same plane as the back bottom panel; and (iii) a third position closed for display in which the main flap is folded with all flap sections parallel to one another and at least one of said side tabs tucked in between the two said flap sections; and (c) a removable panel portion in the front top panel for removal to expose the product.

2. The carton of claim 1 in which in the first closed position for shipping, body projections located on said removable panel project into flap slots located between two of said tandem flap sections for locking body and flap together.

3. The carton of claim 1 having stand elements as part of the back bottom panel and hingedly movable to form a support means.

4. The carton of claim 1 in which the container body contains a paper sheet holding element slightly smaller than the container body and in which the tucked side tab has multiple creases for ease in bending the tab between the body container and the holding element.

5. The carton of claim 1 in which the most remote section of the main flap is inserted between a semicircle piece and the back bottom panel when the top opening flap arrangement is in its second position.

* * * * *